US009227119B2

(12) United States Patent
Jones

(10) Patent No.: US 9,227,119 B2
(45) Date of Patent: Jan. 5, 2016

(54) LOCKING GOLF BAG

(71) Applicant: GUARDIAN GOLF PRODUCTS LLC, Chicago, IL (US)

(72) Inventor: Clifford Desmond Jones, Chicago, IL (US)

(73) Assignee: GUARDIAN GOLF PRODUCTS LLC, Chicago, IL (US)

( * ) Notice: Subject to any disclaimer, the term of this patent is extended or adjusted under 35 U.S.C. 154(b) by 0 days.

(21) Appl. No.: 13/889,976

(22) Filed: May 8, 2013

(65) Prior Publication Data

US 2014/0332421 A1 Nov. 13, 2014

(51) Int. Cl.
*A63B 55/00* (2015.01)

(52) U.S. Cl.
CPC ..... *A63B 55/00* (2013.01); *A63B 2055/002* (2013.01)

(58) Field of Classification Search
CPC ..... A63B 55/00; A63B 2055/007; A63B 2055/002
USPC ..... 206/315.6, 315.3, 315.2
See application file for complete search history.

(56) References Cited

U.S. PATENT DOCUMENTS 4,029,136 A 6/1977 Jacoby
4,194,547 A 3/1980 Sidor et al.
4,241,774 A 12/1980 Pell
4,332,283 A 6/1982 Rader
4,664,382 A 5/1987 Palmer et al.
4,746,014 A 5/1988 Very
4,860,889 A 8/1989 Lemieux et al.
4,911,465 A 3/1990 Hauer
4,944,396 A 7/1990 Larkin
5,028,909 A 7/1991 Miller
5,060,796 A 10/1991 Brooks, III
5,094,345 A 3/1992 Yonnetti
5,267,660 A 12/1993 Kwon
5,392,907 A 2/1995 Blanchard et al.
5,505,300 A 4/1996 Joh
5,509,531 A 4/1996 Patrick et al.
5,524,753 A 6/1996 Murphy
5,573,112 A 11/1996 Kim
5,582,043 A 12/1996 McCue et al.
5,632,690 A 5/1997 McConville
5,636,735 A 6/1997 Stusek
5,775,513 A 7/1998 Anthony
5,799,785 A 9/1998 Hsu
5,834,738 A 11/1998 Wilson
5,853,086 A 12/1998 Chang
5,950,823 A 9/1999 Flis
5,971,146 A 10/1999 Jones
6,102,202 A 8/2000 Jones
6,209,721 B1 * 4/2001 Sharpe et al. ..... 206/315.6
6,216,864 B1 * 4/2001 Chang ..... 206/315.2

(Continued)

*Primary Examiner* — Sue A Weaver
(74) *Attorney, Agent, or Firm* — Ladas & Parry LLP

(57) ABSTRACT

An insert for a golf bag having a generally open top and a generally closed bottom includes a golf club supporting structure in the bag. The insert also includes a compartment for each club. A closure structure is included at the generally open top of the bag and includes an opening for each compartment and a closure member having deflectable closure sections adjacent to each opening at the top of each compartment for each club. A movable tab included in the tubular compartment is deflected by a golf club inserted into the tubular compartment, the deflection is resisted by a cylindrical sheath surrounding the tubular compartment, thereby applying a holding force to the golf club.

17 Claims, 14 Drawing Sheets

(56) References Cited

U.S. PATENT DOCUMENTS

| | | | | |
|---|---|---|---|---|
| 6,341,690 | B1 * | 1/2002 | Swiatosz | 206/315.6 |
| 6,464,076 | B2 * | 10/2002 | Tan | 206/315.6 |
| 6,595,357 | B2 * | 7/2003 | Sutter et al. | 206/315.6 |
| 6,774,792 | B1 * | 8/2004 | Williams | 340/568.6 |
| 6,929,124 | B2 * | 8/2005 | Kawasaki | 206/315.2 |
| 7,025,202 | B2 * | 4/2006 | Jansen et al. | 206/315.3 |
| 7,284,659 | B2 * | 10/2007 | Sugarek et al. | 206/315.6 |
| 2005/0183806 | A1 * | 8/2005 | Lee et al. | 150/160 |

* cited by examiner

LOCKING GOLF BAG

BACKGROUND

In general the present application relates to a golf bag. In particular, the present application relates to a locking golf bag and a locking insert for a golf bag.

Golf remains a popular game as the United States boasts about 25 million participants annually, and the number of rounds played in 2012 totaled over 460 million rounds.

Given the number of manufacturers and the range of bags that each supplies, a large inventory is required by the retailer for products that aesthetically appear quite different but essentially are the same. While most every possible avenue in the golf industry has been explored and aggressively expanded upon in recent years, golf bag design has surprisingly remained stagnant. Most design improvements have centered around storage spaces and specialized compartments.

Figures obtained from the National Golf Foundation and Golf Shop Operations suggest that golfers are willing to pay higher prices for better quality bags. At this time, no other manufacturer offers a product with the design features of the locking golf bag of the present invention.

As will be described in greater detail hereinafter, the present invention relates to a golf bag and a golf bag insert for a golf bag assembly offering total support and protection to a plurality of golf clubs, as well as the bag itself, against theft of individual clubs or the entire bag, against loss of individual clubs arising from negligence by the owner himself/herself, against abrasion damage caused by collision with other clubs within the bag, and finally against rain entering the bag during play. The golf bag also increases ease in locating a particular club, removing and replacing the same.

Golf bag manufacturers are constantly researching the design and construction of their products in order to service the continuing advance in golf club technology. For example, in recent years the number of clubs sold and fitted with graphite shafts, exotic metal heads, and adjustable weights and shafts has skyrocketed. This in turn has created or at least exacerbated certain problems, namely theft and damage. It is not uncommon for individual clubs to cost $500.00 or more these days. Damage can easily occur in the normal configuration of most golf bags, which usually have a dividing structure placed only at the entrance of the bag to create at best six compartments. This does not offer much protection since the heads, shafts, and grips are free to bump and grind together and often can become tangled, which is both burdensome and also potentially harmful to golf clubs. This standard configuration also does nothing to deflect rain or drizzle from entering the bag and soaking the grips of the clubs.

A variety of devices exist in the field of golf bags to assist in organizing the interior of a golf bag. Examples of some of the analogous and non-analogous bags are detailed below.

The Pell U.S. Pat. No. 4,241,774 discloses a foam disc with attached tubes that can be attached inside a golf bag.

The Blanchard et al. U.S. Pat. No. 5,392,907 discloses a series of hexagonal tubes forming a honeycomb pattern which can be encased within a golf bag.

The Rader U.S. Pat. No. 4,332,283 discloses an organizer which utilizes tubes that do not require reinforcing.

These devices in today's market are all but obsolete due to operational deficiencies and the change in today's club characteristics.

Other known golf bag technology shows the development of similar organizers using soft cloth separators as opposed to the harsher plastic tubes previously disclosed.

The Joh U.S. Pat. No. 5,505,300 discloses a divider insert which has a plurality of elongated enclosures and hinge flaps which can be used to separate club heads.

The Kwon U.S. Pat. No. 5,267,660 describes an interesting organizer, which has a series of plates which can be used in different configurations.

These devices, while certainly an improvement over the previous golf bags, must be manually operated and require decisions to be made by the golfer in order to be efficient. Their range of protection is also limited.

The Kim U.S. Pat. No. 5,573,112 shows yet another organizer using a cloth interior. This organizer, while preferred, does not solve the main problem associated with organizer bags, i.e. each club in a set of golf clubs has a different length, and so, even if one separates the shafts of each club by giving each club its own compartment, the head of a shorter club can strike the unprotected area of a shaft of a longer club.

The Hsu U.S. Pat. No. 5,799,785 uses a partitioning rack and a club holding member to secure the club head. Again, this design has a number of deficiencies in that it does not utilize the space inside the bag very well. A very large bag would be required in order to accommodate the partitioning rack. It only specifically protects irons, therefore failing to accommodate putters and woods, which are normally found in a full set of clubs, and has no protection against theft of the clubs stored therein.

While the security devices disclosed in the Murphy U.S. Pat. No. 5,524,753, the McCue U.S. Pat. No. 5,582,043 and the Stusek U.S. Pat. No. 5,636,735 undoubtedly perform the task for which they were intended, they all have limitations which reduce their effectiveness.

Other devices known in the industry suffer from similar limitations which include but are not limited to, ease of operation, the device itself can in certain circumstances cause damage, and range of protection. For example, the Stusek U.S. Pat. No. 5,636,735 discloses a device which protects the clubs in an efficient manner but fails to protect the bag itself.

All the aforementioned patents describe devices which are unquestionably beneficial, however, they all operate within limited parameters and solve only certain problems.

The Jones U.S. Pat. No. 6,102,202, being invented by the inventor of the present invention, solved many of the aforementioned problems in that it provided the following features:

1. An integral security system which alerts owners if their clubs are left behind.
2. A system which protects each club from theft.
3. A system which protects the bag from theft.
4. A system which holds each club in a stable position.
5. A system which is friendly to clubs with graphite shafts.

However, while the Jones U.S. Pat. No. 6,102,202 was an improvement over known golf bag designs, it became apparent over time that the Jones bag is susceptible to failure as an integral security system for alerting users that their clubs are left behind. The operation of the locking device must keep a grip of a club until the locking tab, which keeps the tube from being pushed down when a club is out of the bag, has been engaged. In the Jones U.S. Pat. No. 6,102,202, it is possible that a club having a smaller diameter grip could be removed from the bag in such a way that the locking device would fail to keep a grip of the club until the locking tab has been engaged, thus causing the tube to fall back into the bag even when the club is out, thus defeating an objective of the Jones bag. The Jones U.S. Pat. No. 6,102,202 is incorporated herein by reference in its entirety as if set forth in whole.

It is the object the present invention to solve all described problems and some other difficulties that the state of the art has not yet addressed. In this respect, the locking golf bag and locking insert for a golf bag of the present application offer a wide range of protection for problems previously investigated and also provide for concepts not previously anticipated.

SUMMARY OF THE INVENTION

According to an embodiment, an insert for a golf bag having a generally open top and a generally closed bottom, the insert includes a golf club supporting structure in the bag including a compartment for each club, each compartment being constructed and arranged for movement between a lower golf club gripping position and an upper golf club non-gripping position; a club grip locking device disposed at an end of at least one of the compartments; a moveable tab being defined in a surface of the compartment; and a cylindrical sheath which surrounds a portion of the compartment. The movable tab is configured to be deflected when a club is disposed within the compartment, and the cylindrical sheath is configured to restrict the deflection of the movable tab so as to apply a holding force to a grip of the club.

The movable tab may further includes a cammed member formed on a surface thereof to provide additional holding force to the grip of the club.

The golf bag insert may further include a closure structure for the generally open top of the bag, the closure structure having an opening for each compartment and including a closure member for each opening at the top of each compartment, the closure member for closing the opening at the top of one of the compartments includes deflectable closure sections for closing the opening at the top of one of the compartments around a golf club received in the compartment. Each compartment is generally tubular.

The tubular compartments may have an upper section with a color which contrasts with the color of the bag.

At least one tubular compartment may have an upper section with an inclined upper edge to facilitate upward movement of the at least one tubular compartment against the deflectable sections.

The golf bag insert may further include a guiding plate disposed above the bottom of the golf bag insert, the guiding plate having a plurality of openings defined therein which receive and guide the tubular compartments, a deflectable member disposed on the guiding plate at a position corresponding to the tubular compartments, the deflectable member including a flange at an end thereof, a locking part accepting slot defined in a surface of the club grip locking device which is configured to receive the flange of the deflectable member, and a deflectable protrusion being defined in a surface of the club grip locking device within the locking part accepting slot.

The golf bag insert may further include one or more range limiting tabs attached to the bottom of the cylindrical sheath and configured to extend through the guiding plate. A point of contact between the range limiting tabs and the guiding plate defines an upper range of motion of the cylindrical sheath and a point of contact between the cylindrical sheath and the guiding plate defines a lower range of motion of the cylindrical sheath.

A collar may be mounted in each closure member and has two pins extending inwardly from a wall thereof and the upper section of the tubular compartment has longitudinal slots in a wall thereof for receiving the two pins which are movable therein such that the slots limit upward movement of the tubular compartment when the golf club is moved away from the bottom.

The golf bag insert may include a movable blocking means including blocking structure movable between a blocking position wherein the blocking structure is positioned to engage stop structure on at least one of the tubular compartments to block upward movement of the tubular compartment and a non-blocking position wherein the blocking structure does not engage the stop structure and block upward movement of the tubular compartment.

The bag may have a strap or arm sling with a latch at an outer end thereof, the bag may have an opening therethrough mating with a slot in the golf bag insert for receiving the latch and the blocking structure in the blocking position also blocks removal of the latch from the slot.

The golf bag insert may include a locking structure for locking the blocking structure in the blocking position in engagement with the stop structure and a key for locking and unlocking the locking structure.

The blocking structure may include a plate with apertures therein which receive the tubular compartments and the plate having a plate section associated with and extending into each aperture, each the plate section being movable with the plate to a position to engage the stop structure for blocking movement of the tubular compartments.

Each tubular compartment may have an inclined upper edge defining the stop structure and each the plate section extending into each aperture is movable with said plate to a position above a lower part of one of said inclined edges.

The closure structure has a lateral extent equal to the lateral extent of said generally open top, said closure structure also having a number of said openings equal in number to the number of said compartments and having one of said closure members in each opening, and each closure member comprising an inverted cup shaped closure including a generally cylindrical portion and a plurality of generally pie or wedge shaped sections which are hingedly connected to the cylindrical portion and which together form an opening in the middle of the pie for receiving a shaft of a golf club when the wedge shaped sections are moved inwardly toward a golf club received in one of the compartments.

According to an embodiment, an insert for a golf bag having a generally open top and a generally closed bottom, the insert includes a golf club supporting structure for being received in the bag, the supporting structure includes: a compartment for each club; a closure structure for the generally open top of the bag, the closure structure having an opening for each compartment; each compartment being constructed and arranged for movement between a lower golf club gripping position and an upper golf club non-gripping position; gripping means associated with each compartment for gripping a golf club when the associated compartment is in a lower position; and a club grip locking device disposed at an end of at least one of the compartments; a moveable tab being defined in a surface of the compartment; and a cylindrical sheath which surrounds a portion of the compartment, wherein the movable tab is configured to be deflected when a club is disposed within the compartment, and the cylindrical sheath is configured to restrict the deflection of the movable tab so as to apply a holding force to a grip of the club.

The golf bag insert may include one or more range limiting tabs attached to the bottom of the cylindrical sheath and configured to extend through the guiding plate, where a point of contact between the range limiting tabs and the guiding plate defines an upper range of motion of the cylindrical sheath and a point of contact between the cylindrical sheath and the guiding plate defines a lower range of motion of the cylindrical sheath.

According to an embodiment, an insert for a golf bag having a generally open top and a generally closed bottom, the insert including: a golf club supporting structure in the bag including a tubular compartment for each club; each the tubular compartment being movable, at least in part, with movement of a golf club received therein, between a lower position and an upper position; a closure structure for the generally open top of the bag, the closure structure having a lateral extent equal to the lateral extent of the generally open top and having a number of openings equal in number to the number of the compartments; a club grip locking device disposed at an end of at least one of the tubular compartments; a moveable tab being defined in a surface of the tubular compartment; and a cylindrical sheath which surrounds a portion of the tubular compartment, where when the tubular compartment is in the lower position the movable tab is configured to be deflected and the cylindrical sheath is configured to restrict the deflection of the movable tab so as to apply a holding force to a grip of the club disposed within the tubular compartment.

DESCRIPTION OF PREFERRED EMBODIMENTS

The drawings are not necessarily to scale and in some instances proportions may have been exaggerated in order to more clearly depict certain features of the invention.

Figure 1:
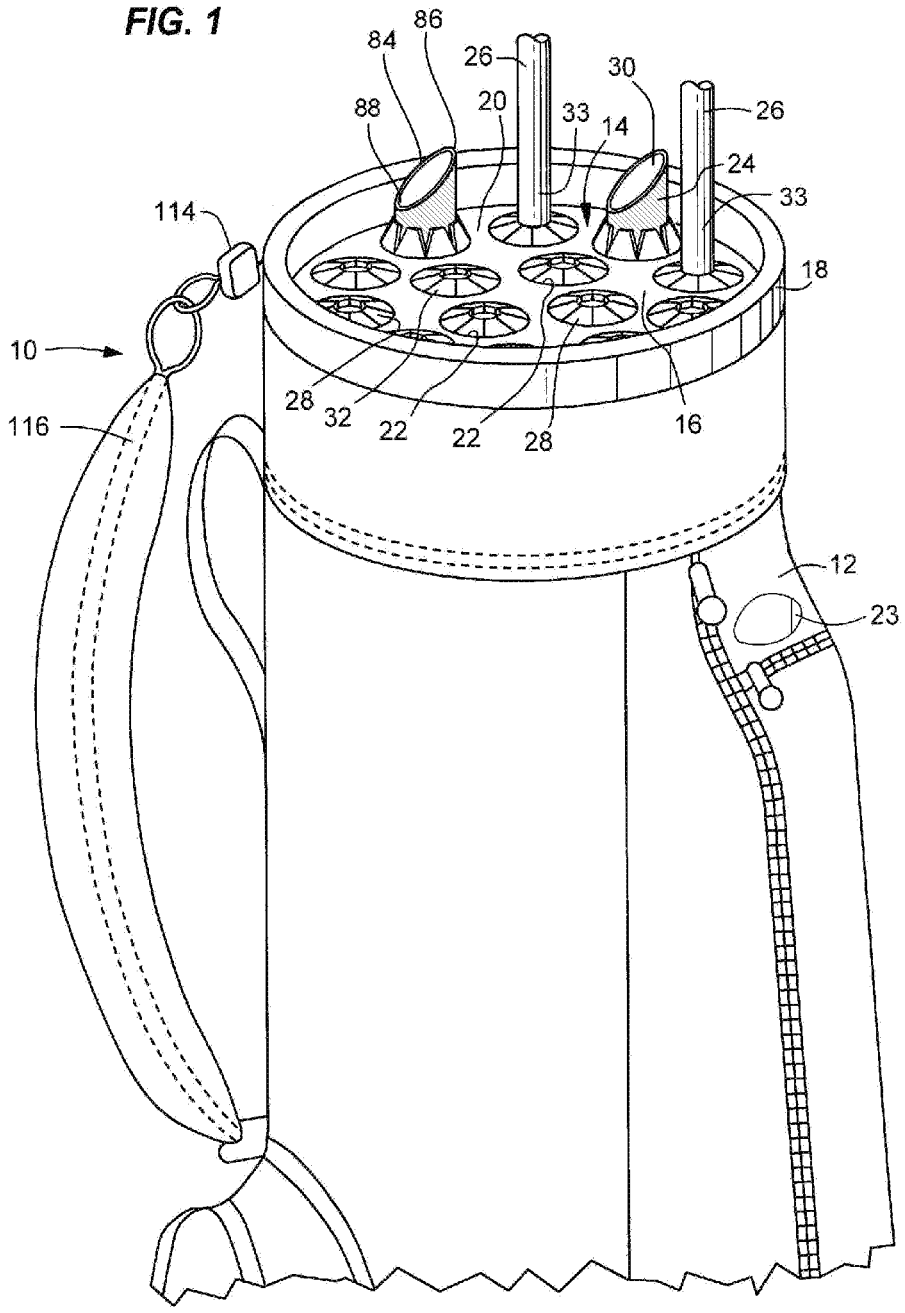
FIG. 1 shows a perspective upper view with portions broken away of a golf bag having the golf bag insert received therein.

Referring now to the drawings in greater detail, there is illustrated in FIG. 1 a golf bag assembly 10 including a golf bag 12 and a golf bag insert 14 (FIG. 2) according to embodiments of the present invention. The golf bag 12 may be constructed integrally with the insert 14 or, alternatively, the golf bag 12 may be a standalone golf bag which is then fit with the golf bag insert 14 therein.

According to an embodiment, an upper end 16 of the insert 14 is shown at a top 18 of the bag 12 and includes a bag closure structure 20 in the top 18 with a plurality of openings 22, e.g., fourteen openings 22 as the typical golfer carries as many has fourteen golf clubs 26, for receiving a number of tubular compartments or tubes 24 respectively each receiving one of fourteen differing golf clubs 26 and with each opening 22 having an inverted cup-shaped closure member 28 (FIGS. 3B and 9) mounted therein. The golf bag 12 may additionally include an external compartment 23 for accommodating a golf club having an atypically shaped grip, such as an anchored putter or a putter with an oversized grip. The external compartment 23 may be located in any number of positions around the periphery of the golf bag 12, for example within a storage pocket 15 as shown in FIG. 1.

In FIG. 1, only three golf clubs 26 are shown extending through the closure members 28 in the openings 22 in the closure structure 20 and only two upper end sections 30 of a tubular compartment or tube 24 are shown extending through the closure members 28, although it is to be understood that in operation the closure members 28 shown in drawing figures will not be closed without a golf club 26 inserted therein. Instead upper end sections 30 of the tubular compartments or tubes 24 will extend through the closure members 28 not having a club 26 therein thus functioning as a reminder to a golfer that golf club 26 is missing from the golf bag 12.

Figure 2:
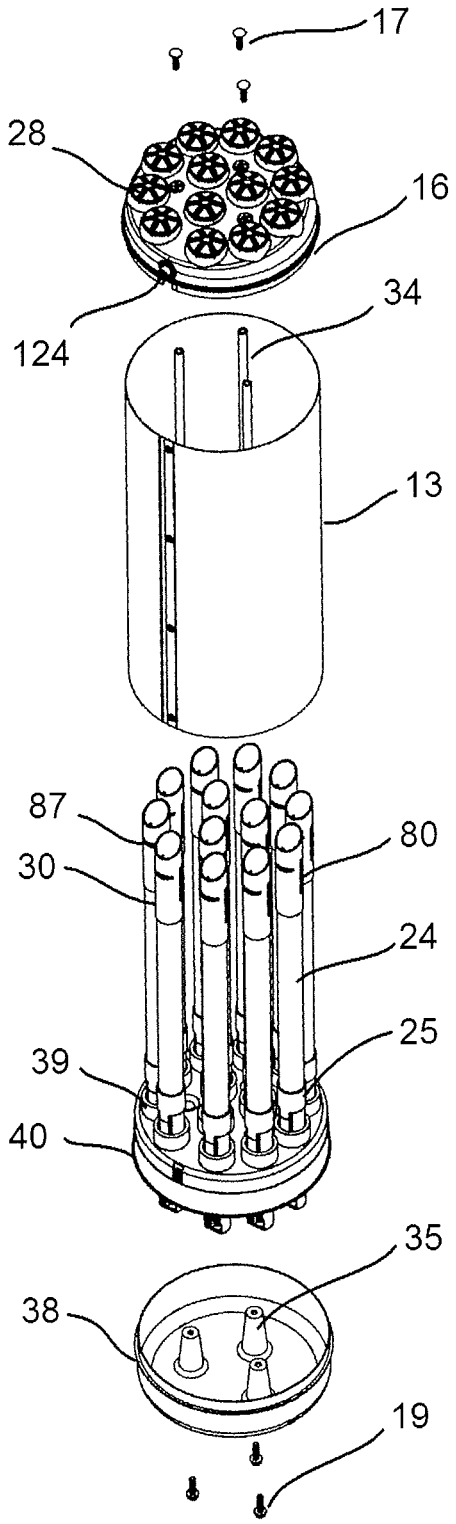
FIG. 2 shows an exploded view of the golf bag insert according to an embodiment.

FIG. 2 shows an exploded view of a golf bag insert 14. As shown in FIG. 2, according to an embodiment, a support cylinder 13 can provide support to the insert 14 in conjunction with the support rods 34. The support cylinder 13 can contact both the upper end of the insert 16 and a lower or bottom plate 38, thus affording support in addition to the support rods 34 which also contact the upper end of the insert 16 and the lower or bottom plate 38 within the insert 14.

Figure 3A:
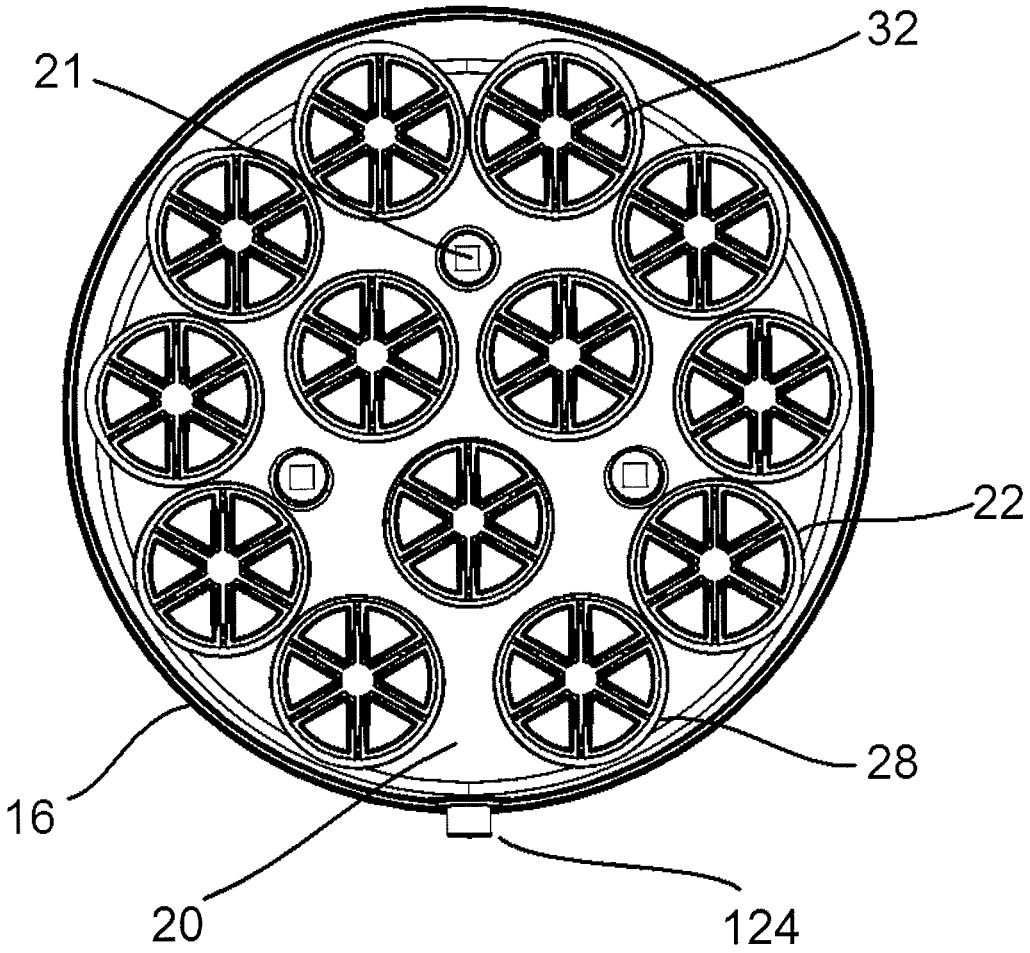
FIG. 3A shows a plan view of the upper end of the insert.
Figure 3B:
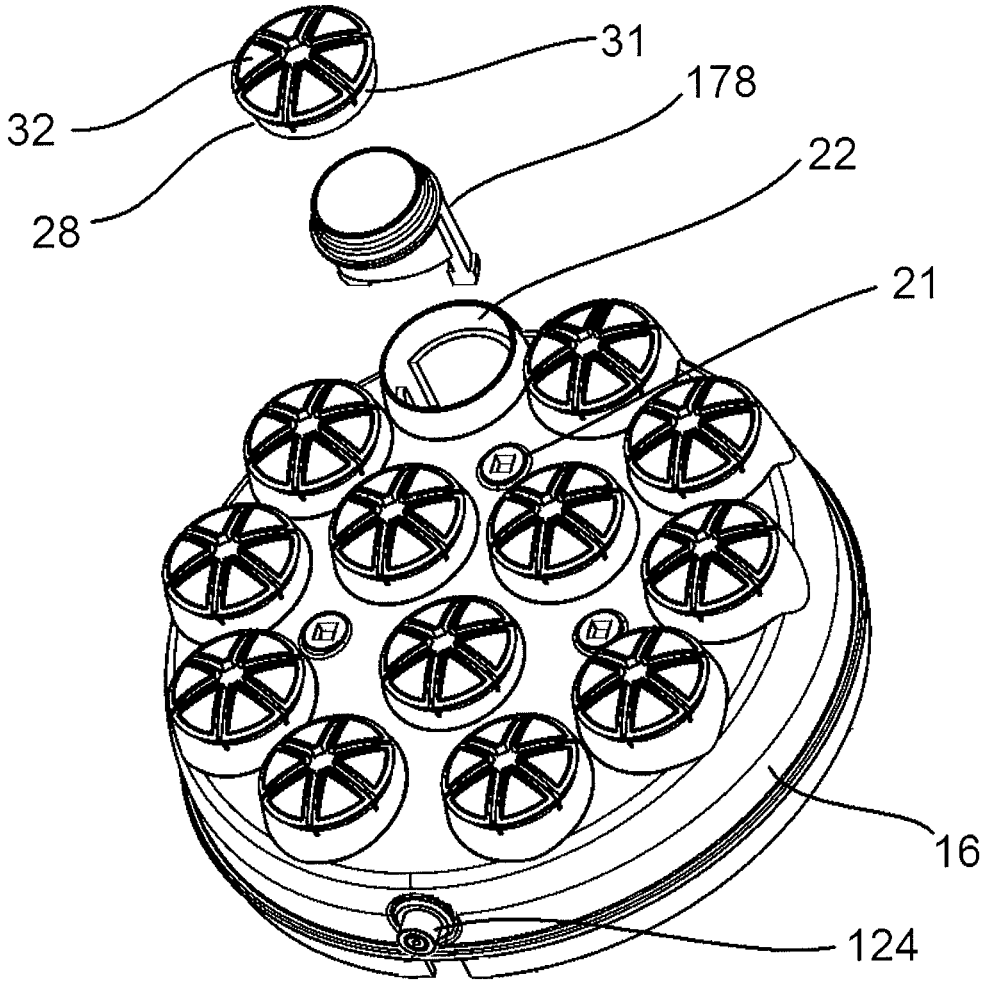
FIG. 3B shows an exploded view of the upper end of the insert.

FIGS. 3A and 3B show an alternate configuration of the upper end of the insert 16. As shown in FIGS. 3A and 3B, the number of cup-shaped closure members 28 corresponds to the number of openings 22 in the closure structure 20 through which golf clubs 26 are received. Also, as shown in FIG. 3B according to an embodiment, the closure structure 20 may be contoured to better highlight the location of each of the holes 22. Also shown in FIGS. 3A and 3B are upper fastening holes 21, which correspond to the support rods 34, described below. The upper fastening holes 21 are configured to facilitate coupling of fasteners 17, as shown in FIG. 2, with the support rods 34 to secure the closer structure 20 to the insert 14.

Figure 9:
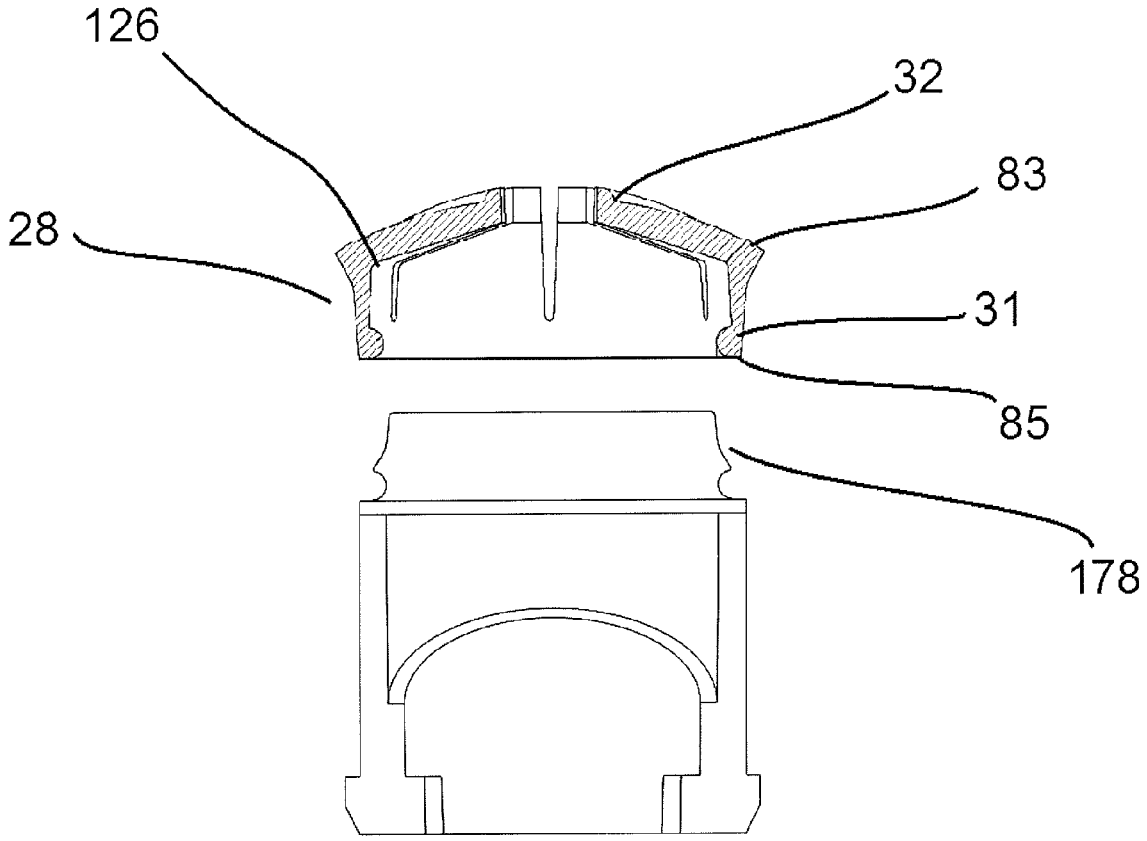
FIG. 9 is an enlarged view of the inverted cup-shaped closer member.

It will be appreciated from FIGS. 3A, 3B, and 9, that each closure member 28 has a plurality pie-shaped or wedge-shaped sections 32 which are hingedly connected to a cylindrical sleeve 31 and which can be deflected upwardly when an upper section 30 of a tubular compartment or tube 24 is raised when removing a club 26 and which fold downwardly around a shaft 33 of a club 26 when the club 26 is reinserted into a tube 24 and the tube 24 is pushed downwardly. For example, the number of pie-shaped or wedge-shaped sections 32 may be six or eight, although the present invention is not limited in this regard. As shown in FIG. 1, when the golf club 26 is fully inserted into the golf bag 12, the closure member 28 closes around the shaft 33 of the club 26, and therefore greatly reduces the amount of debris and moisture (e.g., rain) that can enter the golf bag 12 through the openings 22. FIG. 3B also includes an alternate embodiment of the collar 178, which is adapted to correspond to the unique contours of the upper end of the insert 16.

Figure 4:
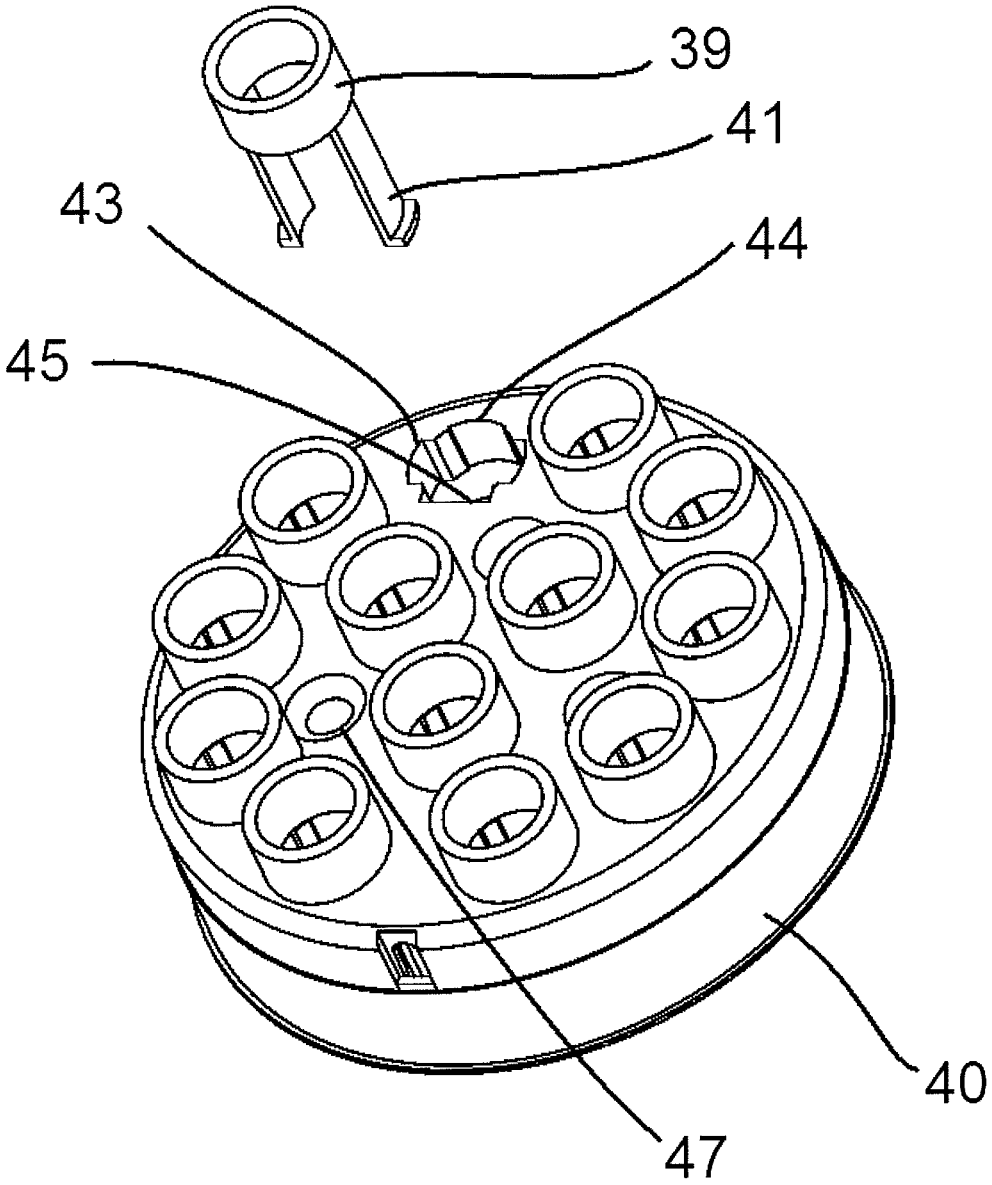
FIG. 4 shows an exploded view of the guiding plate according to an embodiment.

FIG. 4 shows an exploded view of a guiding plate 40 and a cylindrical sheath 39. As shown in FIG. 4 a plurality of openings 44 are defined in the guiding plate 40 which correspond to the plurality of openings 22 formed in the upper end of the insert 20. Each of the openings 44 includes one or more first grooves 43 and one or more second grooves 45, which will be described in greater detail below. A cylindrical sheath 39 is provided in each of the openings 44 and surrounds a portion of a tubular compartment or tube 24 as shown in FIGS. 8A-8D. Extending from a lower portion of the cylindrical sheath 39 are one or more range limiting tabs 41, which extend through the opening 44 defined in the guiding plate 40. According to an embodiment, there are two range limiting tabs 41. As shown in FIG. 4, the first grooves 43 defined in the openings 44 are configured to receive the range limiting tabs 41.

Figure 5:
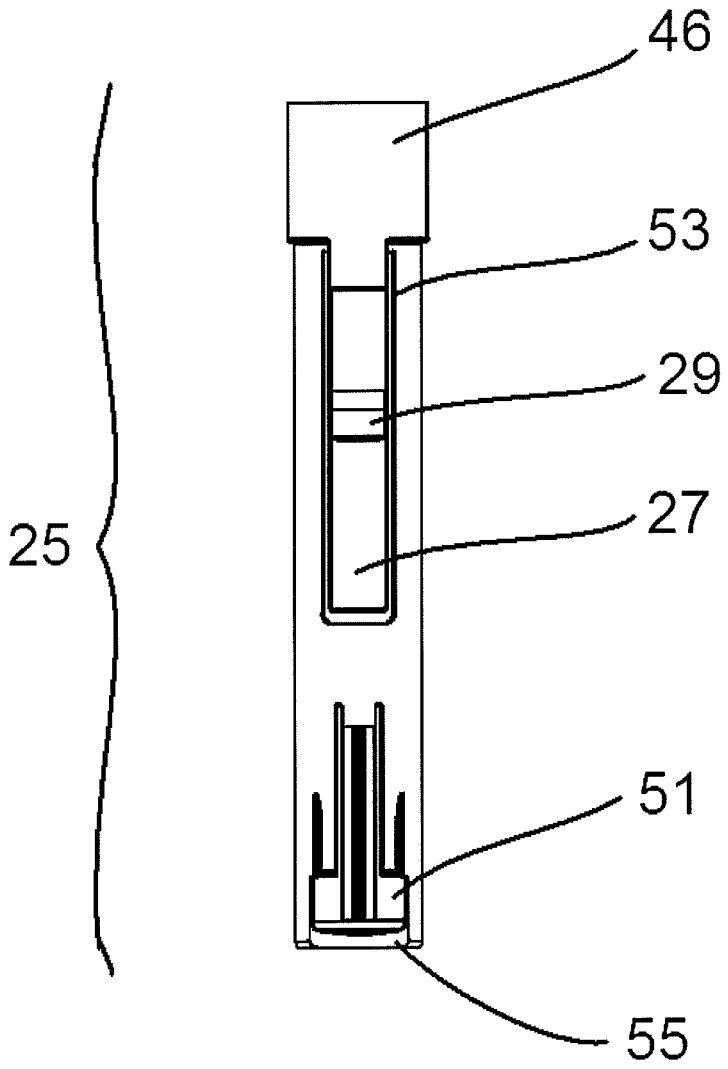
FIG. 5 shows the club grip locking device according to an embodiment.

FIG. 5 shows a club grip locking device 25. The club grip locking device 25 is provided at the lower end of individual tubular compartments or tube 24 such that the tube 24 may be received by the tube receiving portion 46 of the club grip locking device 25. Alternatively, the club grip locking device 25 may be formed integrally with a tube 24. The club grip locking device 25 includes one or more movable tabs 27 which apply a holding force to the golf club grip 42 of the golf club 26 inserted into the tubular compartment or tube 24. According to an embodiment of the present invention the club grip locking device 25 has two movable tabs 27 which include a cammed member 29 formed on at least one of an inner and an outer surface of the movable tab 27 for firmly and safely securing the golf grip 42 when a golf club 26 is inserted into an individual tubular compartment or tube 24, FIG. 5 depicts the cammed member 29 as formed on the outer surface of the movable tabs 27. The cammed member 29 may be integrally formed with the movable tabs 27 or may be separately formed and attached to the movable tabs 27. Optionally, the inner surface of the movable tabs 27 may be rubberized to better enhance the gripping of the golf club grip 42. The movable tabs 27 having the cammed member 29 are flexible members disposed within slots 53 defined in a cylindrical wall of the club grip locking device 25. The club grip locking device 25 also includes a locking part accepting slot 55 having disposed therein a deflectable protrusion 51. The deflectable protrusion will be described in greater detail below.

Figure 6:
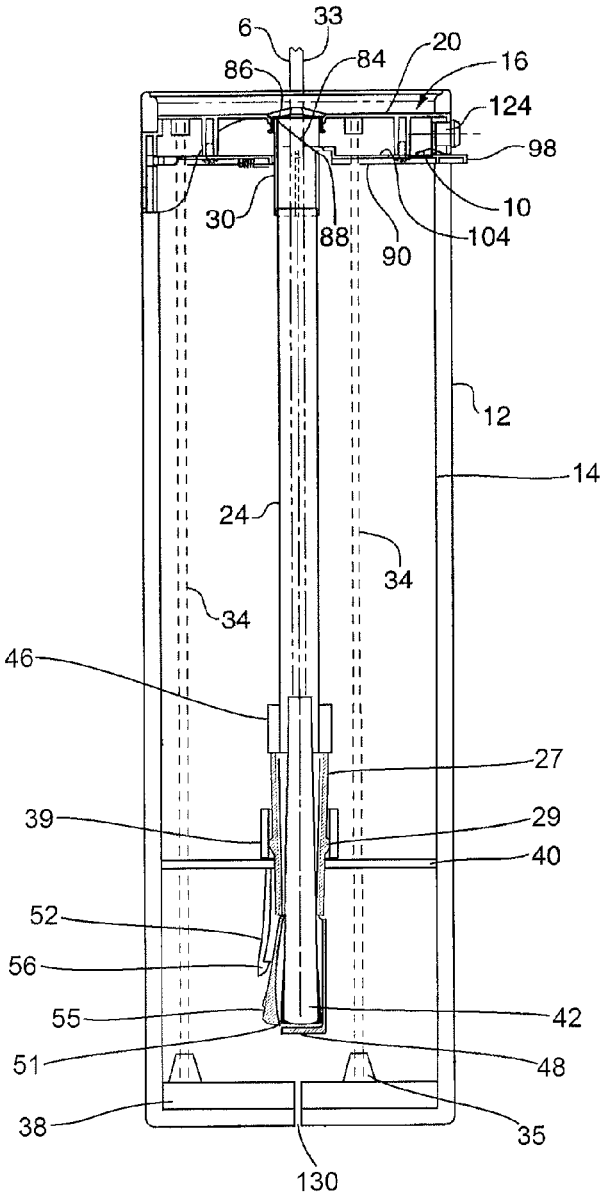
FIG. 6 shows a longitudinal fragmentary sectional view of the golf bag insert of the present invention showing one tubular compartment of the golf bag insert.
Figure 7:
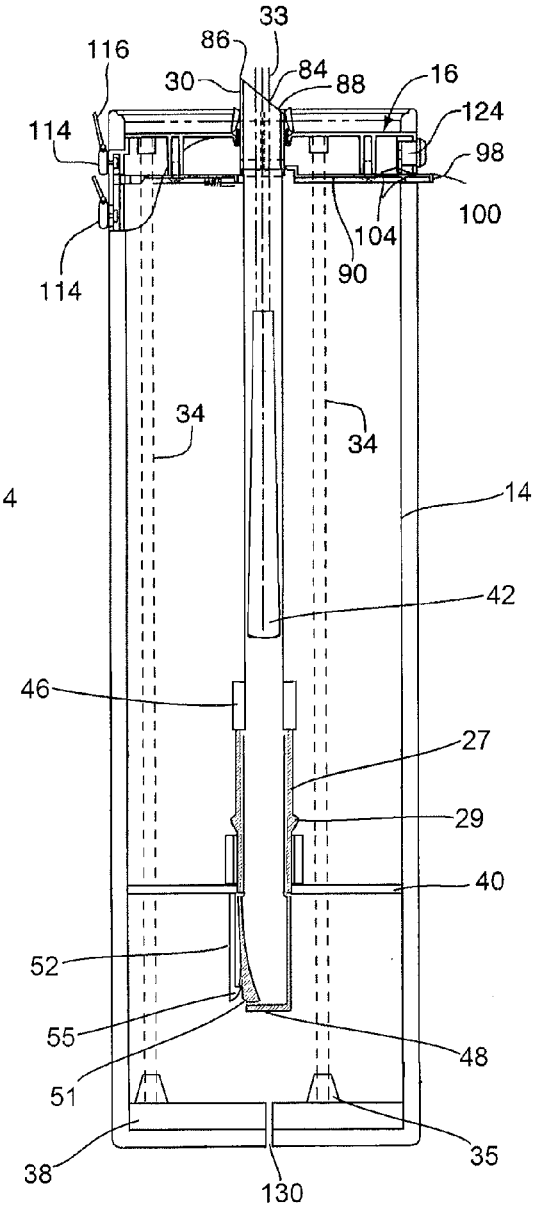
FIG. 7 shows a longitudinal fragmentary sectional view of the golf bag insert of the present invention similar to the view shown in FIG. 3 but showing a tubular compartment in a raised position.

Referring now to FIG. 6, there is illustrated therein a vertical sectional view through the golf bag 12 and through the golf bag insert 14. In this view, only one of the tubular compartments or tubes 24 is shown. Also shown are two of a plurality of support rods 34 which extend between an upper end of the insert 16 of the bag closure structure and a lower or bottom plate 38 and through a guiding plate 40 interposed between the upper end of the insert 16 and the bottom plate 38. In an exemplary embodiment, the number of support rods may be three or four, although the present invention is not limited in this way. In an embodiment the guiding plate 40 includes a plurality of openings 44. The openings 44 correspond to the openings 22 in the closure structure 20 such that the collective openings receive and guide the plurality of tubular compartments or tubes 24. The lower or bottom plate 38 may optionally include additional support members 35 for both supporting the guiding plate 40 and providing access for attaching lower fasteners 19 to the lower end of the support rods 34 as shown in FIG. 2. In an alternative embodiment, the bottom plate 38 may be omitted and plurality of support rods 34 may rest on the base of the golf bag 12 or be secured to the base of the golf bag 12. As shown in FIGS. 6 and 7, plurality of openings 44 defined in the guiding plate 40 are contoured to include first grooves 43 to accommodate one or more range limiting tabs 41 and second grooves 45 to accommodate the cammed members 29. Attached to the bottom of the guiding plate 40 at a position corresponding to each of the plurality of openings 44 is a deflectable member 52, which will be described in detail below.

As shown in FIGS. 4, 6, and 7, the cylindrical sheath 39 surrounds a portion of the club grip locking device 25. Optionally, the inner diameter of the upper portion of the sheath 39 gradually increases such that the upper portion of the cylindrical sheath 39 is slightly curved outward. The sheath 39 configured as above can move vertically along with the range limiting tab 41 within the first grooves 43 of the opening 44 defined in the guiding plate 40, where the upper limit of the motion of the sheath 39 is defined by the point of contact of the range limiting tab 41 and the guiding plate 40, and the lower limit of the motion of the sheath 39 is defined by the point of contact of the cylindrical sheath 39 and the guiding plate 40. The range limiting tabs 41 are not shown in FIGS. 6 and 7 because FIGS. 6 and 7 show a sectional view of a golf bag 12.

The inner diameter of the cylindrical sheath 39 is greater than the outer diameter of the club grip locking device 25 such that the sheath 39 can move freely with respect to the club grip locking device 25 when the movable tabs 27 and the cammed member 29 are not engaged on a golf club grip 42, but the sheath 39 moves along with the club grip locking device 25 when the movable tabs 27 and the cammed member 29 are pushed outwards by the golf club grip 42.

Deflectable members 52 are mounted at a lower surface of the guiding plate 40 at positions corresponding to the openings 44 defined in the guiding plate 40. A lower end of the deflectable member 52 includes a radially inwardly extending flange 56 which is adapted to engage the locking part accepting slot 55 in the club grip locking device 25 when the tube 24 is raised. For example, the radially inwardly extending flange 56 may have an L-shape as shown in FIGS. 6 and 7. The deflectable protrusion 51 of the club grip locking part 25 is deflected by the radially inwardly extended flange 56 when the tube 24 is moved into the upward position, as shown in FIG. 7, and the deflectable protrusion 51 disengages the flange 56 from the locking part accepting slot 55 when deflected outwardly by the end of the golf grip 42 upon insertion of a golf club 26 into a tubular compartment or tube 24, as shown in FIG. 6.

The deflectable member 52, the flange 56, and the deflectable protrusion 51 cooperate with a golf club grip 42 and the tubular compartment or tube 24 to prevent the tubular compartment 24 from being lowered into the lower position until a golf club 26 is inserted into the tubular compartment or tube 24. This is because, without engagement of the protrusion 51, the flange 56 is positioned to engage the locking part accepting slot 55 of the club grip locking device 25. As above, lowering of the tubular compartment or tube 24 prior to insertion of the golf club 26 into the golf bag 12 is not desirable as this prevents the upper end sections 30 of the tubular compartment or tube 24 from acting as a reminder by remaining exposed from the golf bag 12.

In operation, when a golf club 26 is inserted into a tubular compartment or tube 24, the tubular compartment or tube 24 remains static until the golf club grip 42 reaches movable tabs 27 of the grip locking device 25, where the grip 42 will deflect the movable tabs 27 outwardly from club grip locking device 25 until cammed members 29 of the movable tabs 27 engage the cylindrical sheath 39. Once cammed members 29 of the movable tabs 27 engage the cylindrical sheath 39 and the deflectable protrusion 51 is deflected by the grip 42 releasing the flange 56 of the deflectable member 52 from the locking part accepting slot 55, both the cylindrical sheath 39 and the tubular compartment or tube 24 move down with the inserted golf club 26 until the tubular compartment or tube 24 reaches its lower range of motion, which is constrained primarily by two pins 76 mounted on a collar 78 which is fixed to the cylindrical sleeve 31 and received in slots 80 in the upper end section 30. As shown, the pins 76 are received in slots 80 in the upper section 30 and the collar 78 is received in and fixed to the cylindrical sleeve 31 of a cup-shaped closure member 28. This locks the golf club 26 in the tubular compartment or tube 24 so that one cannot pull the golf club 26 upwardly without also pulling the tubular compartment or tube 24 upwardly.

Figure 8A:
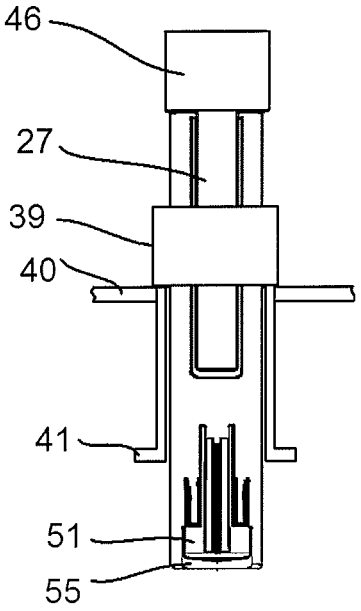
FIGS. 8A, 8B, 8C, and 8D illustrate the upward and downward movement of the club grip locking device associated with the removal and insertion of a golf club into the golf bag.
Figure 8B:
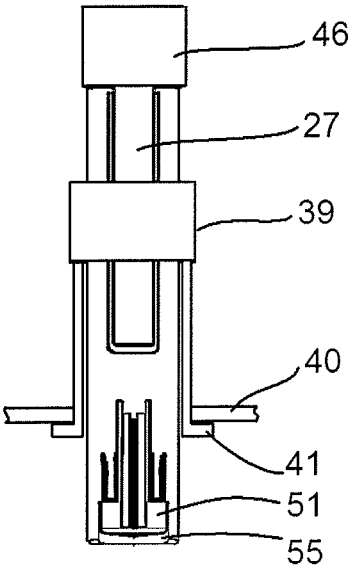
Figure 8C:
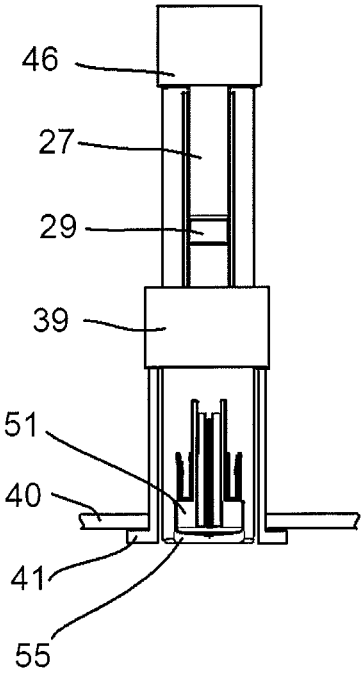
Figure 8D:
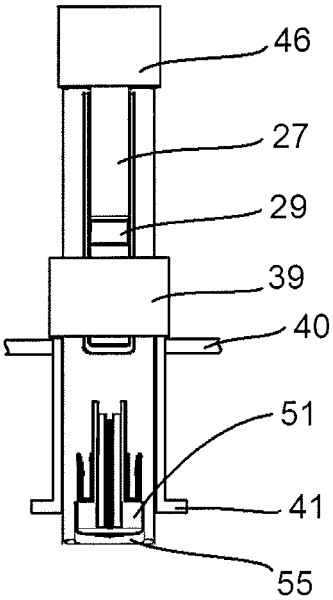

FIGS. 8A-8D illustrate the upward and downward movement of the tubes 24, the club grip locking device 25, and the cylindrical sheath 39. Specifically, FIG. 8A shows the club grip locking device 25 in completely lowered position, FIG. 8B shows the club grip locking device 25 raised to the point of contact between the range limiting tabs 41 and the lower surface of the guiding plate 40, FIG. 8C shows the point where the cammed members 29 clear the cylindrical sheath 39, and FIG. 8D shows the club grip clocking device 25 locked in the up position by the deflectable member 52 (not shown) and the cylindrical sheath 39 dropped down to the upper surface of the guiding plate 40.

In detail, when the tubular compartment 24 and golf club 26 are pulled upwardly as shown in FIG. 8A, the golf club 26 first will move with the tubular compartment 24, the club grip locking device, and the cylindrical sheath 39, since the grip 42 is engaging the moveable tabs 27, which are engaging the cylindrical sheath 39 by way of the cammed members 29, until the golf club 26 and tubular compartment 24 are in the position shown in FIG. 8B, where the range limiting tab 41 contacts the bottom of the guiding plate 40. At this point, the golf club 26, the tubular compartment 24, and club grip locking device 25 continue moving upward until the cammed members 29 of the movable tabs 27 move past the top of the sheath 39 so that the movable tabs 27 no longer engage the grip 42 of the golf club 26, which then can be pulled out of the tubular compartment 24, as shown in FIG. 8C.

Figure 11:
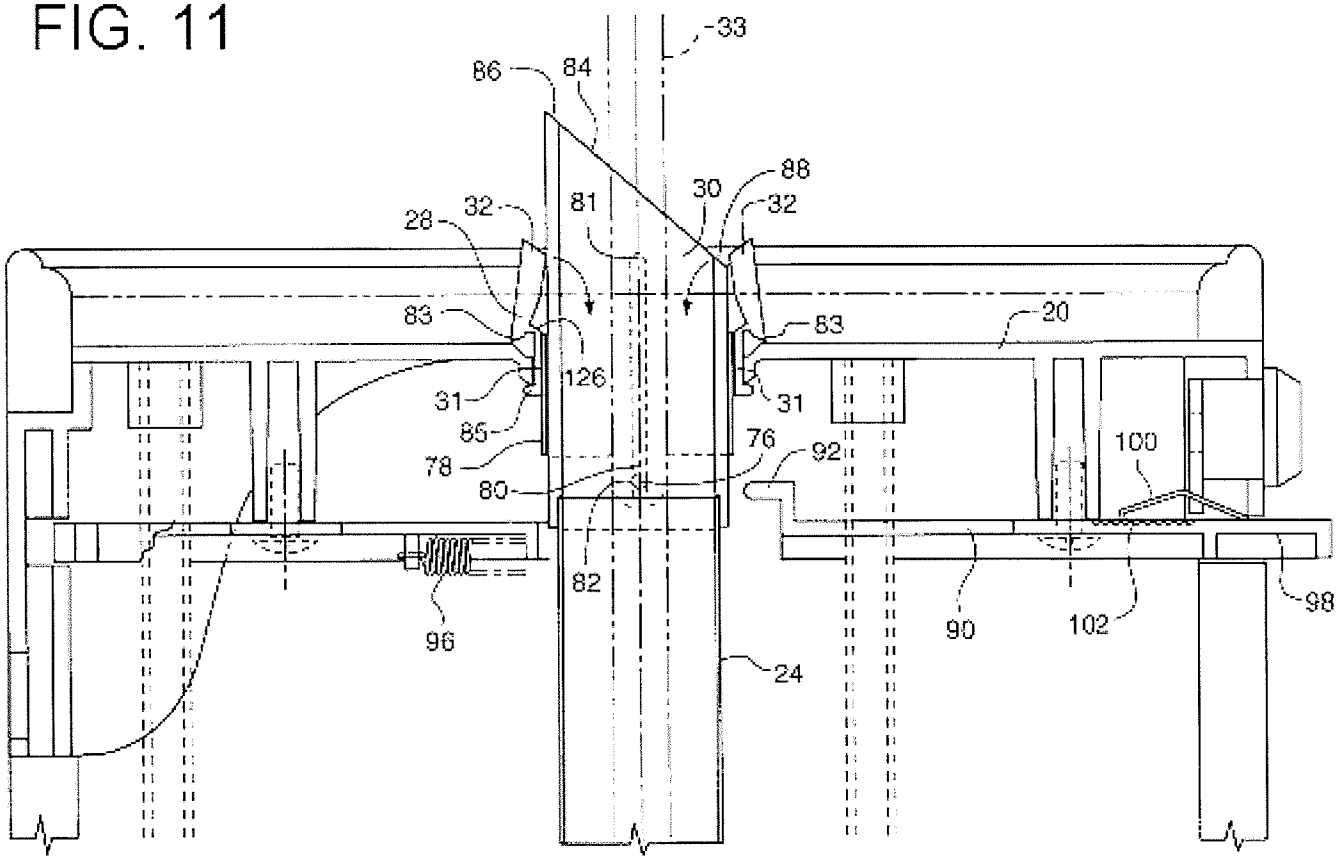
FIG. 11 is an enlarged view of the upper portion of the golf bag insert shown in FIG. 4.

When this is done, the tube 24 and the club grip locking device will drop down until the flange 56 of the deflectable member 52 deflects the deflectable protrusion 51 and engages the locking part accepting slot 55 to assist in preventing downward movement of the tubular compartment or tube 24, as shown in FIG. 8D. The upward movement of the upper end section 30 is constrained primarily by the two pins 76 mounted on the collar 78 which is fixed to the cylindrical sleeve 31 and received in slots 80 in the upper end section 30, as shown in FIG. 11.

An upper end 81 of each slot 80 limits movement of one of the pins 76. A lower end 82 of each slot 80 limits the upper movement of the tubular compartment or tube 24.

When a golf club 26 has been inserted into a tubular compartment 24 and pushed all the way down to the bottom 48 of the tubular compartment 24 thereby deflecting the deflectable protrusion 51 causing the flange 56 to be moved radially outwardly from the locking part accepting slot 55 of the grip locking device 25 allowing the tubular compartment 24 to travel to its bottom position shown in FIG. 6.

Because the upper end section 30 is permanently fixed to the tubular compartment 24, as the tubular compartment 24 is pushed downwardly, the upper end section 30 also moves downwardly. As the travel of the tubular compartment 24 and hence the upper end section 30 also, nears the bottom of the bag 12, the upper ends 81 of the slots 80 reach the pins 76, just as the upper end section 30 falls below the top closure structure 22. The final downward movement of the tubular compartment 24 causes a pulling effect on the cylindrical sleeve 31 of the closure member 28 which causes an upper angular flange 83 at the top of the cylindrical sleeve 31 to engage the bag closure structure 20 in the area around each opening 22 to cause the pie-shaped sections 32 to pivot downwardly to close the opening 22 and engage the shaft 33 of a club 26. A pulling pressure is also exerted on the pins 76 by the upper ends 81 of the slots 80 thereby pulling the closure member 28 downwardly.

As shown, a lower annular flange 85 extends outwardly from the cylindrical sleeve 31 in a position to engage the underside of the bag closure structure 20 in the area around an opening 22 when a club 26 and tubular compartment 24 are pulled upwardly to limit upward movement of the cylindrical sleeve 31 of each closure member 28.

Also when the tubular compartment or tube 24 moves upwardly, the flange 56 at the bottom end of the deflectable member 52 moves into the locking part accepting slot 55 of the grip locking device 25, as shown in FIG. 7.

At this point in time, the tubular compartment or tube 24 is locked in the position shown in FIG. 7 where an upper end section 30 of the tubular compartment 24 extends a short distance above the deflected pie-shaped sections 32 of a closure member 28 and the tubular compartment or tube 24 cannot be raised or lowered until a golf club 26 is reinserted into the tubular compartment 24. The upper end section 30 is preferably colored in a contrasting way, e.g. colored orange, to contrast with a black or brown golf bag 12. Optionally, the upper end sections 30 tubular compartments 24 may include a plurality of different colors to clearly show to the golfer which club or clubs 26 have been removed from the bag 12.

As shown in FIGS. 1, 6, 7, 10, and 11, an upper edge 84 of each upper section 30 of each tubular compartment or tube 24 is an inclined edge 84 extending downwardly from a point 86 to a round 88. This facilitates upward movement of the tubular compartment or tube 24 against the deflectable pie-shaped sections 32 to deflect same upwardly as the golf club 26 and inter-engaged tubular compartment 24 are pulled upwardly.

When the tubular compartment 24 is in the lower position shown in FIG. 6, a locking plate 90, as best shown in FIGS. 6, 7, 10, and 11, can be moved transversely across the golf bag 12 so that a plurality of edges or tabs 92 adjacent one of the openings 94 in the locking plate 90 can be moved into the round 88 of the upper end section 30 of a tube 24. Alternatively, the locking plate 90 can be moved transversely across the golf bag 12 so that a plurality of edges or tabs 92 adjacent one of the openings in the locking plate 90 can be moved into a locking plate receiving slot 87 defined in an upper section 30 of each tubular compartment 24, as shown in FIG. 2. In this way, the golf clubs 26 and tubular compartments 24 are prevented from being pulled upwardly when the bag 12 is in a locked configuration.

Figure 10:
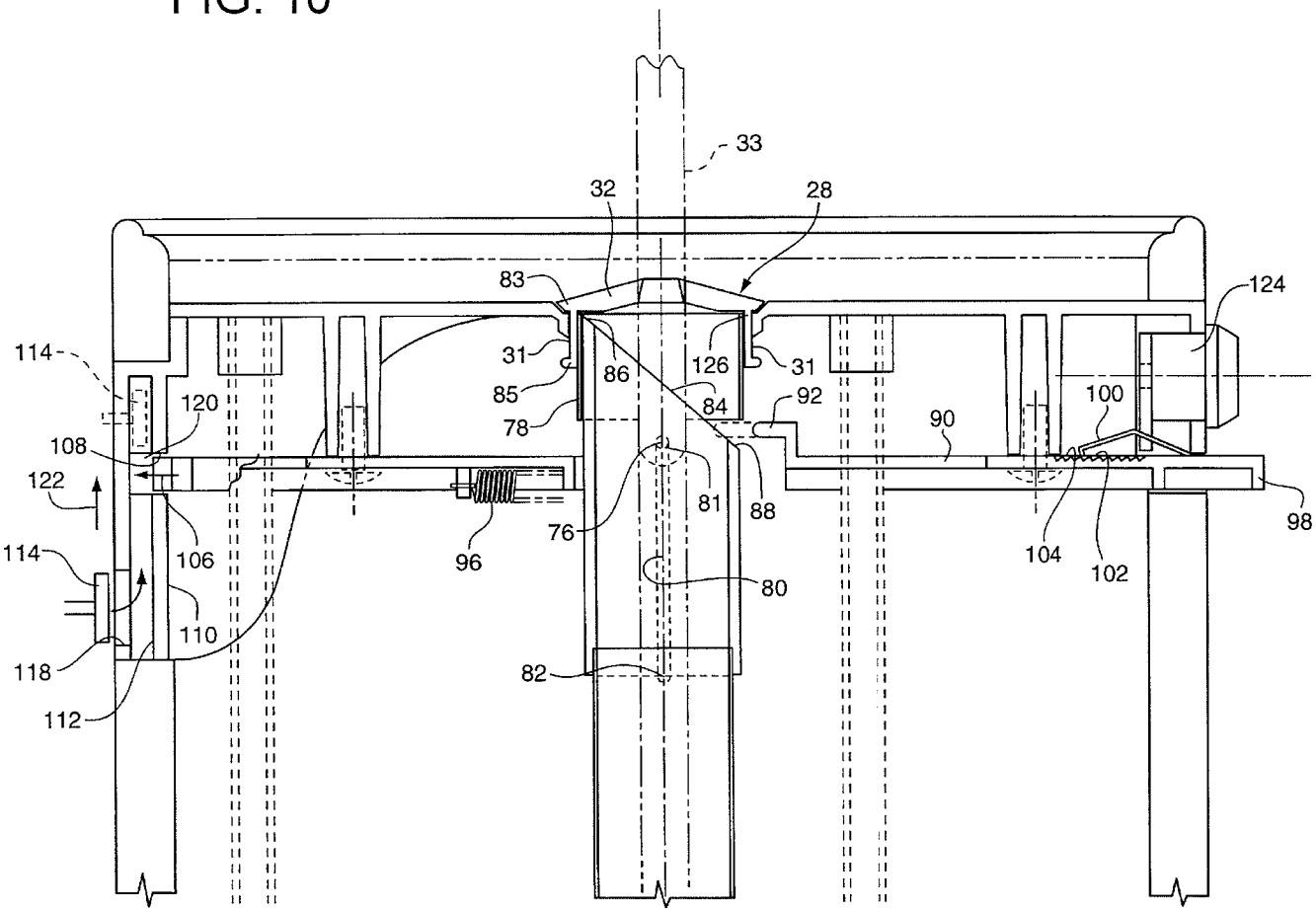
FIG. 10 is an enlarged view of the upper portion of the golf bag insert shown in FIG. 3.

Referring now to FIGS. 10 and 11 in greater detail, it will be seen that the locking plate 90 is urged by a spring 96 from an outer, non-locking position shown in FIG. 10 where a finger gripping portion or handle 98 extends horizontally outwardly from the golf bag 12. In this way, the locking plate 90 can be engaged and pushed inwardly across the bag 12 and insert 14 with the spring 96 pulling the locking plate 90 inwardly. A ratchet spring member 100 engages a sawtooth area 102 on an upper portion 104 of the locking plate 90 to allow the locking plate 90 to be ratcheted while being pulled outwardly against the action of the spring 96 to pull the edges or tabs 92 away from a locking position over the round or lower side 88 of the inclined edge 84. At the same time, an outer end tab 106 of the locking plate 90 is moved out of an opening 108 in a wall structure 110 fixed to the bag closure structure 20. The wall structure has a slot 112 therein and the opening 108 opens into the slot 112 and allows a latch member 114 (FIG. 1) at the end of an arm strap or sling 116 of the golf bag 12 to be inserted through an outer opening 118 in the wall structure 110 into the slot 112 and then upwardly in the slot 112 above the opening 108 for positioning the latch member 114 in a position to be locked to the insert 14 when the end tab 106 is moved into the opening 108 and across the slot 112 beneath the latch 114 to lock the strap 116 of the bag 12 to the bag 12 with the strap received around a bar (not shown) for locking the golf bag 12 to the bar. The latch member 114 is shown in phantom in the locked position in FIG. 10 and the position of the outer end tab 106 of the locking plate 90 for latching the latch member 114 in the slot 112 is indicated by the arrow 120. The direction of insertion of the latch member 114 is indicated by the arrow 122 in FIG. 10.

Further, there is provided a key operated lock 124 for locking the locking plate 90 in its inner latching and locking position where the outer end tab 106 extends across the slot 112 and the tabs 92 are located above the rounds or lower sides 88 of the inclined edges 84 of each tubular compartment or tube 24. In this way, the tubular compartments 24 and the latch member 114, as well as the golf clubs 26 in the tubular compartments 24, are latched to the bag 12 and the bag 12 can be latched to a bar (not shown).

As shown in FIGS. 10 and 11, each collar 78 is received in each closure member 28 and the two pins 76 that extend inwardly from the collar 78 (FIGS. 10 and 11) are received in longitudinal slots 80 in an upper end section 30 of the tubular compartment 24. This provides for proper movement and alignment of the upper end section 30 of the tubular compartment 24 through the collar 78 for engagement with the deflectable pie-shaped sections 32.

Further, it will be understood from FIGS. 5, 6 and 7, that the closure member 28 comprising the pie-shaped or wedge-shaped sections 32 is part of the cup-shaped closure member 28 having the cylindrical sleeve 31 to which each pie-shaped section 32 is connected by a living hinge 126, best shown in FIG. 11, which allows the pie-shaped sections 32 to be deflected upwardly when the upper end section 30 of the tubular compartment or tube 24 having the inclined upper edge 84 is moved upwardly, as shown in FIGS. 10 and 11.

As shown in FIGS. 6 and 7, the bottom plate 38 and/or the bottom of the bag 12 are provided with a plurality of drain holes 130 to drain any water that may enter a tubular compartment 24. Additionally, the drain holes 130 are located at positions corresponding to bottoms the tubes 24. This configuration offers accessibility for an initial configuration of the golf bag 12. That is, the tubes 24 are initially in the downward position so that if a golfer utilizes less than fourteen golf clubs, the golfer can raise a corresponding number of upper end sections 30 during an initial configuration. Through this, the golfer can ensure that the upper end sections 30 will only be exposed when a golf club is removed from the golf bag.

The golf bag and insert of the present invention have a number of advantages, some of which have been described above, and others of which are inherent in the invention.

First of all, the tubular compartments or tubes 24 provide protection for each golf club 26, including the grip 42 and the shaft 33 of the club when it is inserted into the tubular compartment 24.

Next, when the golf club 26 is moved downwardly into the tubular compartment 24, it causes the cammed members 29 of the movable tabs 27 of the club grip locking device 25 to engage the cylindrical sheath 39 to lock the club 26 within the tubular compartment 24.

Then, further movement of the tubular compartment or tube 24 and the club 26 deflect the deflectable members 52 and deflectable protrusion 51 generally outwardly to allow the tubular compartment 24 with a club 26 therein to reach the bottom of the range of motion of the tube 24.

When this occurs, the pie-shaped sections 32 move downwardly and engage around the shaft 33 of the club 26 thereby providing a substantially water tight seal around the shaft 33 of the club 26.

Now, when all of the tubular compartments or tubes 24 with clubs 26 therein are moved downwardly, the locking plate 90 can be moved across the bag 12 to move the tabs 92 above the round or lower side 88 of the inclined edges 84 of the upper sections 30 of the tubular compartments 24, or alternatively into the a locking plate receiving slots 87 defined in the tubular compartments 24, whereby tubular compartments 24 cannot be moved upwardly thereby locking the tubular compartment 24 and the golf club 26 in each tubular compartment 24 in the insert 14 and the bag 12 and preventing removal of any club 26 from the bag 12.

At the same time, the outer tab 106 of the plate 90 moves across the slot 112 and prevents the latch member 114 (similar to a conventional door latch) from being moved downwardly for and out of the slot 112 through the opening 118. This locks the strap 116 to the bag and when the strap 116 is first placed around a bar before the locking occurs, the bag 12 is then locked to the bar.

If desired, the strap 116 could be wire or cable reinforced so that the strap 116 cannot easily be severed if someone tries to steal the bag 12 and that someone cannot simply lift up the golf bag 12 and walk off with it.

Since each of the tubular compartments 24 is mounted in an opening 22 in the closure structure 20, i.e., by means of the cup-shaped closure members 28 and the collars 78 with pins 76 engaging in slots 80 in the upper end sections 30 of the tubular compartments 24, the upper end sections 30 of each of the tubular compartments or tubes 24 are fixed in position thereby to prevent the golf clubs 26 from becoming intertwined with each other. In this way, the golf bag insert 14 of the present invention forms a golf bag organizer.

Figure 12:
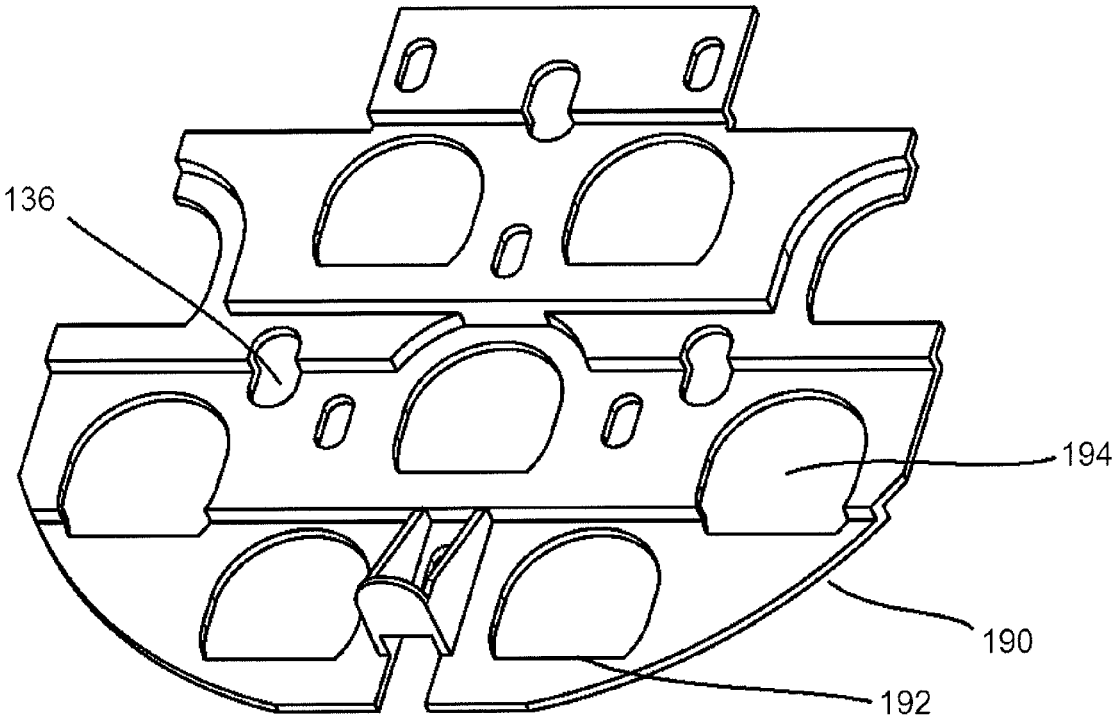
FIG. 12 shows a locking plate according to an alternate embodiment.

FIG. 12 shows an embodiment of the locking plate. As shown in FIG. 12, the locking plate 190 includes openings 194 corresponding to the tubes 24, edges 192, and support rod holes 136.

Figure 13:
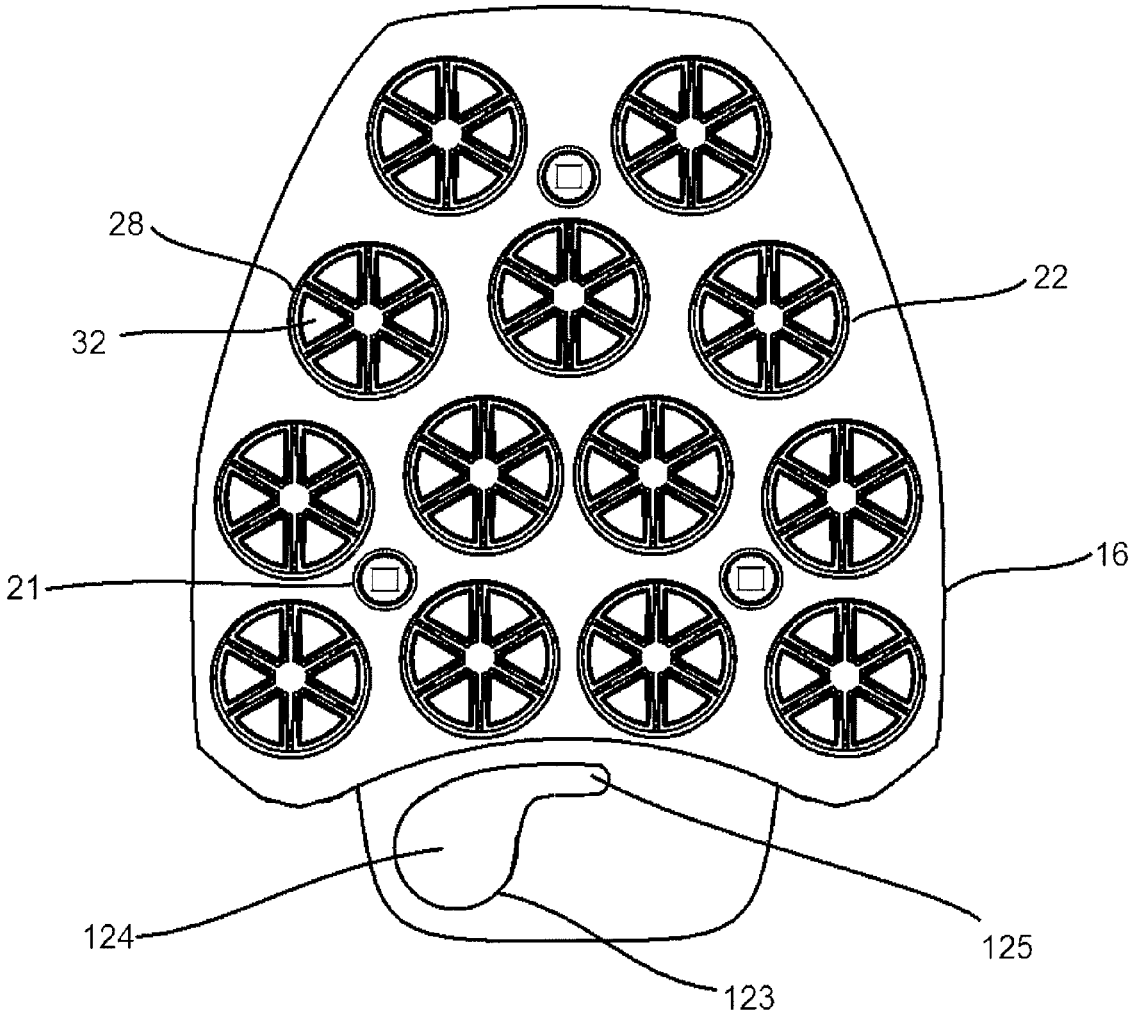
FIG. 13 shows the upper end of the insert according to an embodiment.

FIG. 13 shows an embodiment of the upper end 16 of the insert 14. As shown in FIG. 13, the upper end 16 of the insert 14 includes a plurality of openings 22, having disposed therein cup-shaped closure members 28, and the upper fastening holes 21. The upper end 16 of the insert 14 shown in FIG. 13 further includes an additional opening 123 for accommodating a golf club having an atypically shaped grip, such as an anchored putter or a putter with an oversized grip. The additional opening is defined in the upper end 16 of the insert 14, and may optionally be formed in a portion of the upper end 16 of the insert 14 that is recessed from the portion of the upper end 16 of the insert 14 where the openings 22 are defined, so as to accommodate the shorter length of the typical putter. The additional opening 123 is configured to both receive a golf grip 42 and also securely grip the shaft 33 of the golf club 26 upon insertion within the opening 123. As shown in FIG. 13, the additional opening 123 includes a grip receiving portion 124 and a shaft securing portion 125. In use, the golf grip 42 of the golf club 26 is inserted into grip receiving portion 124 of the additional opening 123 until the grip 42 comes to rest in the receiving slot 49 of the guiding plate 40, described in detail below. The club 26 can then be directed such that the shaft 33 is secured in the shaft securing portion. Therefore, the additional opening 123 is suited to be an alternate location for receiving any club 26.

Figure 14:
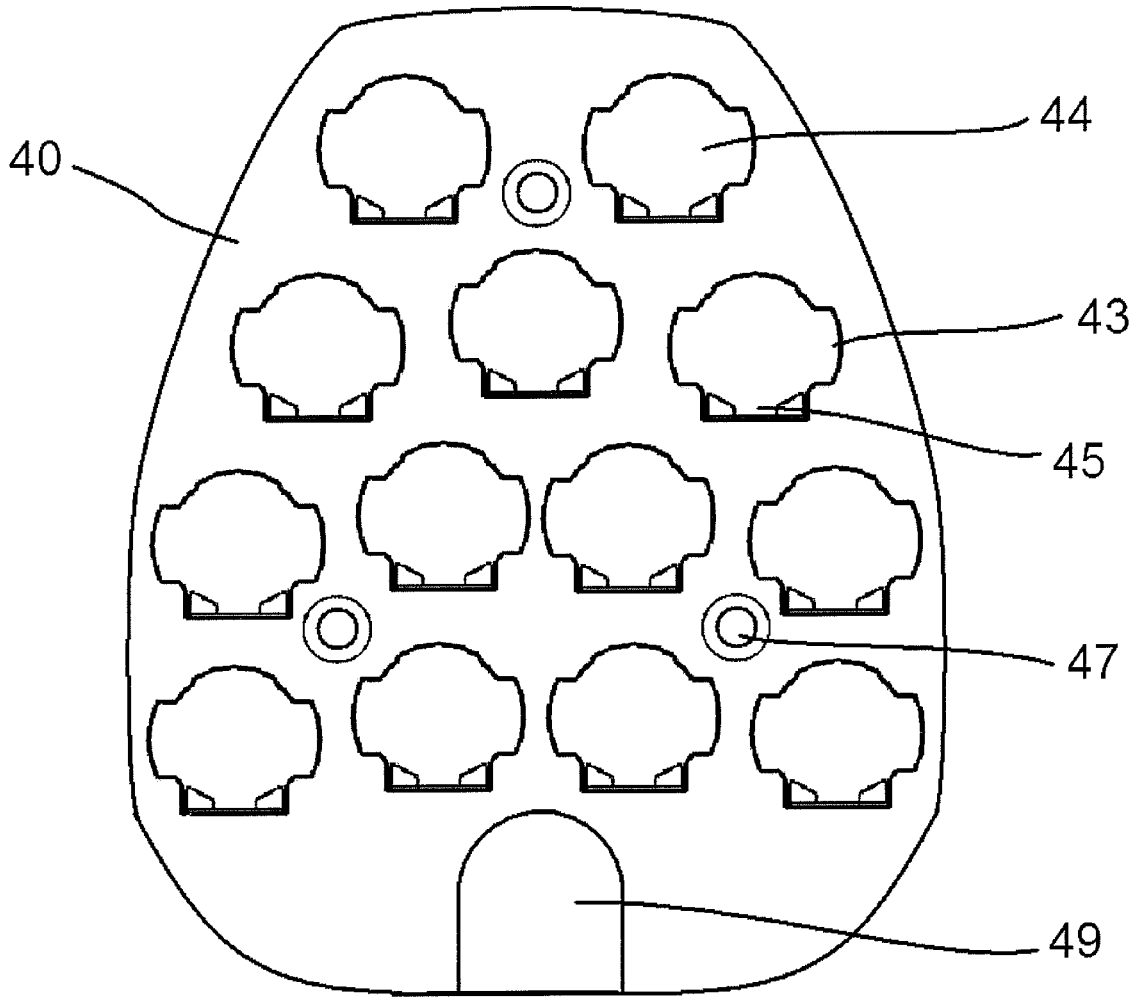
FIG. 14 shows a guiding plate corresponding to the upper end of the insert shown in FIG. 13.

FIG. 14 shows a guiding plate 40 corresponding to the upper end 16 of the insert 14 shown in FIG. 13. As shown in FIG. 14, the guiding plate 40 includes openings 44 and through holes 47. The openings 44 include the first grooves 43 and the second grooves 45. The guiding plate 40 shown in FIG. 14 further includes a grip receiving slot 49 for receiving the grip 42 of a club inserted into the additional opening 123.

Another feature of the golf bag insert 14 of the present invention is the fact that the upper end section 30 of each tubular compartment 24 with the inclined upper edge 84 can be made of a contrasting color to the color of the golf bag 12. In this respect, the bag 12 can be colored black for example, whereas the upper end section 30 of the tubular compartment 24 can be colored orange, or any number of other colors. In this way, when a club 26 is removed from the bag 12, the golfer knows that there is a golf club 26 missing from one of the compartments 12 because of the showing of the orange upper end section 30 of the tubular compartment 24 which contrasts with the color of the bag 12.

Other advantages of the golf bag insert 14 of the present invention are inherent in the golf bag insert 14.

Also, of course, it will be apparent that modifications can be made to the golf bag 12 and the golf bag insert 14 of the present invention without departing from the teachings of the invention. Accordingly, the scope of the invention is only to be limited as necessitated by the accompanying claims.

I claim:

1. An insert for a golf bag having a generally open top and a generally closed bottom, the insert comprising:

a golf club supporting structure in the bag including a compartment for each club, each compartment being constructed and arranged for movement between a lower golf club gripping position and an upper golf club non-gripping position;

a club grip locking device disposed at an end of at least one of the compartments;

a guiding plate disposed above the bottom of the golf bag insert, the guiding plate having a plurality of openings defined therein which receive and guide the compartments;

a moveable tab being defined in a surface of the club grip locking device, wherein the movable tab extends in a longitudinal direction away from the end of the compartment and is configured to be deflected radially relative to the compartment; and a cylindrical sheath which surrounds a portion of the club grip locking device, the cylindrical sheath having one or more range limiting tabs attached to a bottom thereof, the one or more range limiting tabs configured to extend through the guiding plate, wherein a point of contact between the range limiting tabs and the guiding plate defines an upper range of motion of the cylindrical sheath in the longitudinal direction and a point of contact between the bottom of the cylindrical sheath and the guiding plate defines a lower range of motion of the cylindrical sheath in the longitudinal direction, wherein the cylindrical sheath is configured deflect the movable tab radially inward so as to apply a holding force to a grip of the club when the compartment is in the lower golf club gripping position.

2. The golf bag insert of claim 1, wherein the movable tab further comprises a cammed member formed on a surface thereof to provide additional holding force to the grip of the club when the compartment is in the lower golf club gripping position.

3. The golf bag insert of claim 2, further comprising a closure structure for the generally open top of the bag, the closure structure having an opening for each compartment and including a closure member for each opening at the top of each compartment, wherein the closure member for closing the opening at the top of one of the compartments includes deflectable closure sections for closing the opening at the top of one of the compartments around a golf club received in the compartment.

4. The golf bag insert of claim 3, wherein each compartment is generally tubular.

5. The golf bag insert of claim 4, wherein the tubular compartments have an upper section with a color which contrasts with the color of the bag.

6. The golf bag insert of claim 4, wherein at least one tubular compartment has an upper section with an inclined upper edge to facilitate upward movement of the at least one tubular compartment against the deflectable sections.

7. The golf bag insert of claim 4, further comprising a deflectable member disposed on the guiding plate at a position corresponding to the tubular compartments, the deflectable member including a flange at an end thereof;

a locking part accepting slot defined in a surface of the club grip locking device which is configured to receive the flange of the deflectable member; and a deflectable protrusion being defined in a surface of the club grip locking device within the locking part accepting slot.

8. The golf bag insert of claim 4, wherein a collar is mounted in each closure member and has two pins extending inwardly from a wall thereof and the upper section of the tubular compartment has longitudinal slots in a wall thereof for receiving the two pins which are movable therein such that the slots limit upward movement of the tubular compartment when the golf club is moved away from the bottom.

9. The golf bag insert of claim 4, including a locking plate movable between a locking position wherein the locking plate is positioned to engage stop structure on at least one of the tubular compartments to block upward movement of the tubular compartment and a non-locking position wherein the locking plate does not engage the stop structure and block upward movement of the tubular compartment.

10. The golf bag insert of claim 9, wherein the bag has a strap or arm sling with a latch at an outer end thereof, the bag has an opening therethrough mating with a slot in the golf bag insert for receiving the latch and the locking plate in the locking position also blocks removal of the latch from the slot.

11. The golf bag insert of claim 9, including a locking structure for locking the locking plate in the locking position in engagement with the stop structure and a key for locking and unlocking the locking structure.

12. The golf bag insert of claim 9, wherein the locking plate includes a plate with apertures therein which receive the tubular compartments and the plate having a plate section associated with and extending into each aperture, each the plate section being movable with the plate to a position to engage the stop structure for blocking movement of the tubular compartments.

13. The golf bag insert of claim 12, wherein each tubular compartment has an inclined upper edge defining the stop structure and each the plate section extending into each aperture is movable with the plate to a position above a lower part of one of the inclined edges.

14. The golf club bag of claim 1, further comprising a closure structure for the generally open top of the bag, wherein the closure structure has a lateral extent equal to the lateral extent of the generally open top, the closure structure also having a number of the openings equal in number to the number of the compartments and having a closure member for each opening, and each closure member comprising an inverted cup shaped closure including a generally cylindrical portion and a plurality of generally pie or wedge shaped sections which are hingedly connected to the cylindrical portion and which together form an opening in the middle of the pie for receiving a shaft of a golf club when the wedge shaped sections are moved inwardly toward a golf club received in one of the compartments.

15. An insert for a golf bag having a generally open top and a generally closed bottom, the insert comprising:

a golf club supporting structure for being received in the bag, the supporting structure including:

a compartment for each club;

a closure structure for the generally open top of the bag, the closure structure having an opening for each compartment;

each compartment being constructed and arranged for movement between a lower golf club gripping position and an upper golf club non-gripping position;

a club grip locking device disposed at an end of at least one of the compartments;

a guiding plate disposed above the bottom of the golf bag insert, the guiding plate having a plurality of openings defined therein which receive and guide the compartments;

a moveable tab being defined in a surface of the club grip locking device for gripping a golf club when the compartment is in the lower golf club gripping position, wherein the movable tab extends in a longitudinal direction away from the end of the compartment and is configured to be deflected radially relative to the compartment; and a cylindrical sheath which surrounds a portion of the compartment, the cylindrical sheath having one or more range limiting tabs attached to a bottom of thereof, the one or more range limiting tabs configured to extend through the guiding plate, wherein a point of contact between the range limiting tabs and the guiding plate defines an upper range of motion of the cylindrical sheath in the longitudinal direction and a point of contact between the bottom of the cylindrical sheath and the guiding plate defines a lower range of motion of the cylindrical sheath in the longitudinal direction, wherein the cylindrical sheath is configured deflect the movable tab radially inward so as to apply a holding force to a grip of the club when the compartment is in the lower golf club gripping position.

16. An insert for a golf bag having a generally open top and a generally closed bottom, the insert comprising:

golf club supporting structure in the bag including a tubular compartment for each club;

each the tubular compartment being movable, at least in part, with movement of a golf club received therein, between a lower position and an upper position;

a closure structure for the generally open top of the bag, the closure structure having a lateral extent equal to the lateral extent of the generally open top and having a number of first openings equal in number to the number of the compartments;

a club grip locking device disposed at an end of at least one of the tubular compartments;

a guiding plate disposed above the bottom of the golf bag insert, the guiding plate having a plurality of openings defined therein which receive and guide the tubular compartments;

a moveable tab being defined in a surface of the tubular compartment, wherein the movable tab extends in a longitudinal direction away from the end of the tubular compartment and is configured to be deflected radially relative to the tubular compartment; and a cylindrical sheath which surrounds a portion of the tubular compartment, the cylindrical sheath having one or more range limiting tabs attached to a bottom thereof, the one or more range limiting tabs configured to extend through the guiding plate, wherein a point of contact between the range limiting tabs and the guiding plate defines an upper range of motion of the cylindrical sheath in the longitudinal direction and a point of contact between the bottom of the cylindrical sheath and the guiding plate defines a lower range of motion of the cylindrical sheath in the longitudinal direction, wherein the cylindrical sheath is configured deflect the movable tab radially inward so as to apply a holding force to a grip of the club when the compartment is in the lower golf club gripping position.

17. The golf bag insert of claim 16, wherein the closure structure further comprises:

a second opening which includes a grip receiving portion and a shaft securing portion.

* * * * *